US010851432B2

(12) United States Patent
Dong et al.

(10) Patent No.: US 10,851,432 B2
(45) Date of Patent: Dec. 1, 2020

(54) ULTRA-HIGH STRENGTH AND ULTRA-HIGH TOUGHNESS CASING STEEL, OIL CASING, AND MANUFACTURING METHOD THEREOF

(71) Applicant: BAOSHAN IRON & STEEL CO., LTD., Shanghai (CN)

(72) Inventors: Xiaoming Dong, Shanghai (CN); Zhonghua Zhang, Shanghai (CN); Xiaodong Jin, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 199 days.

(21) Appl. No.: 15/736,835

(22) PCT Filed: Jun. 17, 2016

(86) PCT No.: PCT/CN2016/086114
§ 371 (c)(1),
(2) Date: Dec. 15, 2017

(87) PCT Pub. No.: WO2016/202282
PCT Pub. Date: Dec. 22, 2016

(65) Prior Publication Data

US 2018/0291475 A1 Oct. 11, 2018

(30) Foreign Application Priority Data

Jun. 18, 2015 (CN) ..... 2015 1 0340874

(51) Int. Cl.
*C21D 9/14* (2006.01)
*C22C 38/24* (2006.01)
(Continued)

(52) U.S. Cl.
CPC ..... *C21D 9/14* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 4,375,995 A * 3/1983 Sugino ..... C21D 9/04 148/584
4,933,008 A 6/1990 Fujiki et al.
(Continued)

FOREIGN PATENT DOCUMENTS

CN 103045964 A 4/2013
CN 103938095 A 7/2014
CN 104233107 A 12/2014

*Primary Examiner* — Sheng H Davis
*Assistant Examiner* — Christopher Douglas Moody
(74) *Attorney, Agent, or Firm* — Neal, Gerber & Eisenberg LLP

(57) ABSTRACT

The present invention discloses an ultra-high strength and ultra-high toughness casing steel, having a microstructure of tempered sorbite, and the content of chemical elements by mass percent thereof being as follows: C: 0.1-0.22%, Si: 0.1-0.4%, Mn: 0.5-1.5%, Cr: 1-1.5%, Mo: 1-1.5%, Nb: 0.01-0.04%, V: 0.2-0.3%, Al: 0.01-0.05%, Ca: 0.0005-0.005%, the balance being Fe and unavoidable impurities. Correspondingly, the invention also discloses a casing obtained by processing the ultra-high strength and ultra-high toughness casing steel and a manufacturing method thereof. The ultra-high strength and ultra-toughness casing steel and the casing of the present invention have a strength of 155 ksi or more and an impact toughness greater than 10% of its yield strength value, thereby realizing a combination of ultra-high strength and ultra-high toughness.

13 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/18*** | (2006.01) |
| ***C21D 6/00*** | (2006.01) |
| ***C21D 8/10*** | (2006.01) |
| ***C22C 38/00*** | (2006.01) |
| ***C22C 38/22*** | (2006.01) |
| ***C22C 38/26*** | (2006.01) |
| ***E21B 17/00*** | (2006.01) |

(52) U.S. Cl.

CPC ..... *C21D 8/105* (2013.01); *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01); *E21B 17/00* (2013.01)

(56) References Cited

U.S. PATENT DOCUMENTS

| | | | | |
|---|---|---|---|---|
| 6,358,336 | B1 * | 3/2002 | Miyata | C21D 1/28 148/328 |
| 2009/0044882 | A1 * | 2/2009 | Asahi | C21D 1/22 148/506 |
| 2009/0098403 | A1 * | 4/2009 | Omura | C21D 8/12 428/586 |
| 2009/0188589 | A1 * | 7/2009 | Okitsu | C21D 6/005 148/504 |
| 2015/0329950 | A1 * | 11/2015 | Azuma | C21D 9/46 148/533 |
| 2015/0376730 | A1 * | 12/2015 | Shuto | C22C 38/02 428/659 |
| 2016/0053355 | A1 * | 2/2016 | Takagi | C22C 38/00 148/637 |
| 2017/0219000 | A1 * | 8/2017 | Matsumoto | C22C 38/48 |

* cited by examiner

ULTRA-HIGH STRENGTH AND ULTRA-HIGH TOUGHNESS CASING STEEL, OIL CASING, AND MANUFACTURING METHOD THEREOF

CROSS-REFERENCE TO RELATED APPLICATIONS

This is a national stage filing in accordance with 35 U.S.C. § 371 of PCT/CN2016/08611.4, filed Jun. 9, 2016, which claims the benefit of the priority of Chinese Patent Application CN 20151340874, filed Jun. 18, 2015, the contents of each are incorporated herein by reference.

TECHNICAL FIELD

The present invention relates to a steel material and manufacturing method thereof, and particularly to a casing and manufacturing method thereof.

BACKGROUND ART

Deep wells and ultra-deep wells are more and more widely developed in the field of petroleum exploration and development in recent years, and in order to ensure the safety of high temperature and high pressure mining development, higher requirements for the strength of the column materials are put forward. However, in general, the toughness decreases as the strength of the steel increases, and insufficient toughness of a thinning steel pipe easily causes early cracks and fractures. Therefore, high strength casing steel must have high toughness in order to ensure the safety of the tubular column.

According to the guidance of the British Department of Energy, the impact toughness of the pressure vessel should reach 10% of its yield strength value, that is to say, the toughness required by 155 ksi steel grade casing material should reach 107 J or more. However, the reality is that steel pipes with high toughness and high strength are extremely difficult to develop. Currently, the strength of the casing for industrial applications can reach 155 ksi or more, but the impact toughness is only 50-80 J.

Japanese Patent Document No. JP11131189A discloses a steel pipe product which is heated in the range of 750-400° C. and then rolled in the range of 20% or more or 60% or more of deformation to produce a steel pipe with good toughness, which has a yield strength of 950 MPa or more. However, the inventors of the present invention believe that the heating temperature of the process is low, easy to produce martensite. Besides, the rolling temperature is low, and thus it is hard to roll.

Japanese Patent Document No. JP04059941A also discloses a steel pipe product, which controls the ratio of residual austenite and upper bainite in a steel matrix through a heat treatment process so that the tensile strength reaches 120 to 160 ksi. The technical solution is characterized by high content of carbon and silicon, both of which can significantly increase the strength but significantly reduce the toughness. In addition, the inventors of the present invention believe that the residual austenite will undergo phase transformation during the use of the pipe (the temperature of the deep well is 120° C. or more), which leads to the steel pipe decreasing toughness while increasing strength.

Chinese Patent Publication No. CN101250671, with a Publication Date of Aug. 27, 2008, entitled "casing with High-Strength and High Toughness and Manufacturing Method Thereof" also discloses a high-strength and high-toughness steel, having a chemical element ratio as follows: C: 0.22~0.4%, Si: 0.17~0.35%, Mn: 0.45~0.60%, Cr: 0.95~1.10%, Mo: 0.70~0.80%, Al: 0.015~0.040%, Ni<0.20%, Cu<0.20%, V: 0.070~0.100%, Ca>0.0015%, P<0.010%, S<0.003%, and the balance being Fe. The manufacturing process comprises the following steps of: (i) batching smelting; (ii) continuously casting and rolling; (iii) tube processing. However, the transverse impact toughness of the casing is only 80 J.

SUMMARY OF INVENTION

One of the objects of the present invention is to provide an ultra-high strength and ultra-high toughness casing steel having a strength of 155 ksi or more and an impact toughness much greater than 10% of its yield strength value, thereby enabling the combination of ultra-high strength and ultra-high toughness.

In order to achieve the above object, the present invention discloses an ultra-high strength and ultra-high toughness casing steel, having a microstructure of tempered sorbite, the content by mass percent of chemical elements thereof being as follows: C: 0.1-0.22%, Si: 0.1-0.4%, Mn: 0.5-1.5%, Cr: 1-1.5%, Mo: 1-1.5%, Nb: 0.01-0.04%, V: 0.2-0.3%, Al: 0.01-0.05%, Ca: 0.0005-0.005%, the balance being Fe and unavoidable impurities.

The composition design principle for the ultra-high strength and ultra-high toughness casing steel according to the present invention is as follows.

C: As a precipitate forming elements, C can improve the strength of steel. In the present technical solution, if the C content is less than 0.10%, the hardenability is decreased, and thus the strength is decreased, and the material strength is hard to reach 155 ksi or more; and if the C content is more than 0.22%, it then forms a large amount of coarsened precipitates with Cr and Mo, and significantly enhances the segregation of steel, resulting in significantly reduced toughness, and it is difficult to achieve the requirements of high strength and high toughness.

Si: The solid solution of Si in ferrite can improve the yield strength of the steel. However, the Si element should not be too high. If the Si element content is too high, processability and toughness will deteriorate. If the Si elemental content is less than 0.1%, the steel may be easily oxidized.

Mn: As an austenite-forming element, Mn can improve the hardenability of the steel. In the present technical solution, if the Mn element content is less than 5%, the hardenability of the steel is significantly reduced, the proportion of the martensite is reduced and thereby the toughness is reduced; if the content is more than 1.5%, the composition segregation in the steel is remarkably increased, and the uniformity and impact properties of the hot-rolled microstructure are affected.

Cr: Cr is an element that strongly enhances hardenability and is a strong precipitate-forming element. Its precipitates produced when tempered improve the strength of the steel. In the present technical solution, if the Cr content is more than 1.5%, coarse $M_{23}C_6$ precipitates tend to be precipitated at grain boundaries to reduce, toughness, but if the content is less than 1%, the hardenability tends to be insufficient.

Mo: Mo mainly improves the strength and tempering stability of the steel by precipitates and solid solution strengthening. In the present technical solution, since the content of carbon is low, it is difficult to have a significant effect on the strength improvement even if Mo is added in excess of 1.5%, but it will cause the alloy waste. In addition, if the Mo content is less than 1%, the strength of 155 ksi or more cannot be guaranteed.

Nb: Nb is a grain refining and precipitation-strengthening element that can compensate for the decrease in strength caused by a decrease in carbon content. In the present technical solution, if the Nb content is less than 0.01%, it cannot exert its effect. If the Nb content is more than 0.04%, coarse Nb (CN) is likely to form, resulting in a decreased toughness.

V: V is a typical precipitation-strengthening element that can compensate for the decrease in strength caused by a decrease in carbon content. In the present technical solution, if the V content is less than 0.2%, the strengthening effect is hard to make the material reach 155 ksi or more. If the V content is more than 0.3%, coarse V (CN) is likely to form, thereby decreasing the toughness.

Al: In the steel, Al plays a role of deoxidation and grain refinement, and additionally improves the stability and corrosion resistance of the surface film layer. When the addition amount is less than 0.01%, the effect is not obvious. When the addition amount exceeds 0.05%, the mechanical properties may deteriorate.

Ca: Ca can purify the molten steel and promote the spheroidization of MnS, thereby improving the impact toughness. However, if the Ca content is too high, it is easy to form coarse non-metallic inclusions, which is disadvantageous to the present technical solution.

Further, in the ultra-high strength and ultra-high toughness casing steel according to the present invention, the precipitates on the tempered sorbite include at least one of a carbonitride of Nb and a carbonitride of V.

Further, the carbonitride of Nb has a size of 100 nm or less, and the said carbonitride of V has a size of 100 nm or less.

More preferably, the ultra-high strength and ultra-high toughness casing steel according to the present invention further satisfies a relation of $1 \leq (V+Nb)/C \leq 2.3$ so that the harmful precipitates of Cr and/or the harmful precipitates of Mo on the tempered sorbite are extremely lessened Preferably, the ultra-high strength and ultra-high toughness casing steel according to the present invention further has Ti, and the Ti content satisfies $0 < Ti \leq 0.04\%$.

The Ti element is a strong carbonitride forming element that can significantly refine austenite grains to compensate for the decrease in strength caused by a decrease in carbon content. However, if its content is higher than 0.04%, it is easy to form coarse TiN, thereby reducing the material toughness.

Based on the above technical solution, furthermore, the precipitates on the tempered sorbite comprise at least one of a carbonitride of Nb, a carbonitride of V and a carbonitride of Ti.

In the prior art, the conventional high-strength steel having a strength of 155 ksi or more generally adopts low-alloy steel, that is, alloying elements such as Cr, Mo, V, Nb and the like are added to the carbon-manganese steel. By the precipitation strengthening effect of the precipitates formed from the carbon with the alloying elements, the strength of the steel is improved. The content of C is generally about 0.3%, but the precipitates of the alloying elements are brittle phase, and if the alloy content is too high, the precipitates tend to aggregate and grow coarse during the precipitation, which will dramatically reduce the toughness of material.

The idea of the present invention is to break through the current methods of increasing strength mainly by Cr, Mo alloying elements, and alternatively, use the method of mainly adopting the solid solution strengthening of Mn, Cr and Mo and supplementarily adopting the precipitation strengthening of V, Nb (in some embodiments, including Ti) for increasing the strength of material. In the technical solution, the present invention employs a low-carbon composition design that preferentially forms uniformly distributed fine precipitates of V, Nb (in some embodiments, including Ti) utilizing the stability of the precipitates of the precipitates of V, Nb (in some embodiments, including Ti) so as to increase the strength of the steel while maintaining the toughness. As a result, alloying elements such as Cr, Mo are mainly present in the matrix in the form of solid solution, thereby eliminating the deterioration of toughness due to the coarse precipitates of Cr and Mo while obtaining good solid solution strengthening effect, thereby obtaining good strength and toughness.

Further, in the ultra-high strength and ultra-high toughness casing steel according to the present invention, the carbonitride of Nb has a size of 100 nm or less, the carbonitride of V has a size of 100 nm or less, and the carbonitride of Ti has a size of 100 nm or less.

More preferably, the chemical elements of the ultra-high strength and ultra-high toughness casing steel according to the present invention further satisfies a relation of $1 \leq (V+Nb)/C \leq 2.3$, so that the harmful precipitates of Cr and/or the harmful precipitates of Mo on the tempered sorbite are extremely few.

According to the TEM analysis results of different precipitates, the precipitates of Cr, Mo, V, Nb and the likes mainly playing a strengthening role in the steel, are different in size and morphology. The Cr element is mainly present in the form of $Cr_{23}C_6$, and such precipitate tends to aggregates at the grain boundaries and are larger in size, generally about 150-250 nm. The Mo element is mainly present in the form of $Mo_2C$, and such precipitate also tends to aggregate at the grain boundaries (certainly, it is also precipitated in the crystal) and are medium in size, generally about 100-150 nm. The V, Nb, and Ti elements are mainly present in the form of (V, Nb, Ti)(C, N), and such precipitates are uniformly precipitated in the crystal and are small in size. According to the Smith cleavage crack nucleation model, if precipitates on grain boundaries increase in thickness or diameter, the cleavage crack is easy to form and easy to expand, so the brittleness increases. The Cr and Mo coarse precipitates distributed in the matrix can form micropores due to their own cracking or the dissociation from the interface of the matrix, and micropores connect and grow up to form cracks, and eventually lead to fracture. Therefore, in order to obtain a higher toughness index, the precipitated carbonitride of Nb and/or carbonitride of V must be controlled to 100 nm or less in size, while it is preferable to minimize the occurrence of Cr and Mo precipitates at 150-250 nm.

Further, in the ultra-high strength and ultra-high toughness casing steel according to the present invention, in the unavoidable impurities, $P \leq 0.015\%$, $S \leq 0.003\%$, and $N \leq 0.008\%$.

In the technical solution, the unavoidable impurities are mainly P, S and N. Therefore, the content of these impurity elements should be as low as possible.

Another object of the present invention is to provide an oil casing, which achieves a strength level of 155 ksi or more while having an ultrahigh toughness matching the ultra-high strength.

Based on the above invention object, the present invention provides a casing produced by using the above ultra-high strength and ultra-high toughness casing steel.

In some embodiments, the casing is a 155 ksi grade casing which has a yield strength of 1069-1276 MPa, a tensile strength≥1138 MPa, an elongation of 20%-25%, a 0 degree transverse Charpy impact energy≥130 J, and a ductile-brittle transition temperature≤−60° C.

In other embodiments, the casing is a 170 ksi grade casing which has a yield strength of 1172-1379 MPa, a tensile strength≥1241 MPa, an elongation of 18%-25%, a 0 degree transverse Charpy impact energy≥120 J, and a ductile-brittle transition temperature≤−50° C.

Still another object of the present invention is to provide a method for manufacturing the oil casing, the casing produced by the method can achieve the strength of 155 ksi or more, and has the ultrahigh toughness matching the ultrahigh strength.

Based on the above invention object, the present invention provides a method for manufacturing the oil casing, comprising the steps of:

(1) smelting and casting;

(2) piercing and rolling;

(3) heat treatment.

Further, in the step (3), using an austenitizing temperature of 920-950° C., quenching after holding for 30-60 minutes, and then tempering at 600-650° C., holding for 50-80 minutes, then hot sizing at 500-550° C.

Further, in the step (2), the continuous cast slab obtained through the step (1) is heated and soaked, the soaking temperature is 1200-1240° C., the piercing temperature is controlled at 1180-1240° C., and the finishing rolling temperature is controlled at 900-950° C.

Compared with the prior art, the present invention has the following beneficial effects:

(1) The casing steel according to the present invention can be used for producing a casing of 155 ksi steel grade or more, which has an excellent combination of high strength and high toughness, and an excellent low temperature impact toughness;

(2) The casing according to the present invention can achieve the following performance index:

For 155 ksi steel grade oil casing: a yield strength of 1069-1276 MPa, a tensile strength≥1138 MPa, an elongation of 20%-25%, a 0 degree transverse Charpy impact energy≥130 J (10% of yield strength of 155 ksi steel grade is 107 J), and a ductile-brittle transition temperature≤−60° C.

For 170 ksi steel grade oil casing: a yield strength of 1172-1379 MPa, a tensile strength≥1241 MPa, an elongation of 18%-25%, a 0 degree transverse Charpy impact energy≥120 J (10% of yield strength of 170 ksi steel grade is 120 J), and a ductile-brittle transition temperature≤−50° C.

(3) The heat treatment process in the manufacturing method of the casing according to the present invention is simple and easy to implement in mass production.

DESCRIPTION OF EMBODIMENTS

Figure 1:
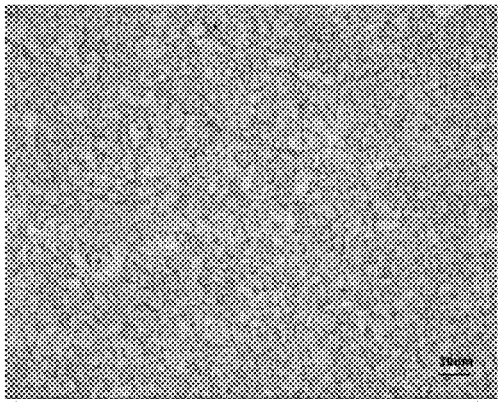
FIG. 1 shows the microstructure of Example 5 of the present invention.

The ultra-high strength and ultra-high toughness casing steel, casing and the manufacturing method thereof according to the present invention will be further explained and illustrated with reference to the accompanying drawings and specific examples. However, the present technical solution is not limited to these explanation and illustration.

Examples 1-5 and Comparative Examples 1~3

The casing in Examples 1-5 of the present invention and the casing in Comparative Examples 1-3 are prepared according to the following steps (The formulations of the elements in each Example and Comparative Example are shown in Table 1, and the specific process parameters in each Example and Comparative Example are shown in Table 2).

(1) Smelting: the molten steel is smelted in the electric furnace, secondarily refined, degassed by vacuum and agitated by argon, then subjected to Ca treatment to denature inclusions and reduce the contents of O and H;

(2) Casting: The superheat of molten steel in the casting process is control to below 30° C.;

(3) Piercing and rolling of the steel pipe: After the continuous cast slab is cooled, it is heated in an annular heating furnace, and is soaked at 1200-1240° C., the perforation temperature is 1180-1240° C. and the finishing rolling temperature is 900-950° C.;

(4) Heat treatment: using an austenitizing temperature of 920-950° C., quenching after holding for 30-60 minutes, and then tempering at 600-650° C. high temperature, holding for 50-80 minutes, and then hot straightening at 500-550° C.

Table 1 shows the formulations of the chemical elements in mass percentage of each casing in Examples 1-5 and Comparative Examples 1-3 of the present invention.

TABLE 1

(The balance is Fe and impurities other than S, P, and N, wt. %)

| | C | Mn | Si | Cr | Mo | V | Ti | Nb | Al | Ca | P | S | N | (V + Nb)/C |
|---|---|---|---|---|---|---|---|---|---|---|---|---|---|---|
| Example 1 | 0.1 | 0.5 | 0.2 | 1 | 1 | 0.2 | 0.01 | 0.01 | 0.01 | 0.0005 | 0.009 | 0.002 | 0.004 | 2.10 |
| Example 2 | 0.12 | 0.7 | 0.1 | 1.2 | 1.2 | 0.25 | 0.01 | 0.02 | 0.04 | 0.001 | 0.010 | 0.001 | 0.005 | 2.25 |
| Example 3 | 0.14 | 0.9 | 0.3 | 1.3 | 1.3 | 0.3 | 0.02 | 0.01 | 0.05 | 0.005 | 0.010 | 0.003 | 0.006 | 2.21 |
| Example 4 | 0.18 | 1.1 | 0.4 | 1.4 | 1.4 | 0.27 | 0.04 | 0.01 | 0.03 | 0.003 | 0.012 | 0.002 | 0.007 | 1.56 |

TABLE 1-continued (The balance is Fe and impurities other than S, P, and N, wt. %)

| | C | Mn | Si | Cr | Mo | V | Ti | Nb | Al | Ca | P | S | N | (V + Nb)/C |
|---|---|---|---|---|---|---|---|---|---|---|---|---|---|---|
| Example 5 | 0.22 | 1.5 | 0.25 | 1.5 | 1.5 | 0.22 | 0 | 0.04 | 0.02 | 0.002 | 0.013 | 0.002 | 0.008 | 1.18 |
| Comparative Example 1 | 0.08 | 0.5 | 0.26 | 1.1 | 0.8 | 0.15 | 0.02 | 0.02 | 0.023 | 0.002 | 0.007 | 0.003 | 0.008 | 2.13 |
| Comparative Example 2 | 0.28 | 1.1 | 0.4 | 1.4 | 1.4 | 0.25 | 0.04 | 0.01 | 0.03 | 0.003 | 0.012 | 0.002 | 0.007 | 0.93 |
| Comparative Example 3 | 0.22 | 1.1 | 0.4 | 1.1 | 1.2 | 0.2 | 0 | 0.01 | 0.04 | 0.001 | 0.010 | 0.001 | 0.006 | 0.95 |

Table 2 shows the specific process parameters in Examples 1-5 and Comparative Examples 1-3 of the present invention.

TABLE 2

| | Austenitizing Temperature (° C.) | Holding Time (min) | Tempering Temperature (° C.) | Holding Time (min) | Hot straightening Temperature (° C.) |
|---|---|---|---|---|---|
| Example 1 | 920 | 50 | 600 | 50 | 510 |
| Example 2 | 930 | 30 | 650 | 60 | 500 |
| Example 3 | 940 | 60 | 630 | 60 | 530 |
| Example 4 | 950 | 60 | 620 | 80 | 550 |
| Example 5 | 930 | 40 | 610 | 70 | 520 |
| Comparative Example 1 | 930 | 40 | 620 | 70 | 510 |
| Comparative Example 2 | 930 | 60 | 620 | 60 | 530 |
| Comparative Example 3 | 940 | 40 | 620 | 60 | 520 |

Table 3 shows the performance parameters of Examples 1-5 and Comparative Examples 1-3 of the present invention.

TABLE 3

| | Yield Strength MPa | Tensile Strength MPa | Elongation % | Transverse Charpy Impact Energy (0° C.) J | Ductile-Brittle Transition Temperature ° C. |
|---|---|---|---|---|---|
| Example 1 | 1080 | 1140 | 25 | 152 | −70 |
| Example 2 | 1090 | 1160 | 23 | 148 | −65 |
| Example 3 | 1130 | 1190 | 21 | 142 | −60 |
| Example 4 | 1180 | 1180 | 20 | 130 | −55 |
| Example 5 | 1210 | 1260 | 19 | 128 | −55 |
| Comparative Example 1 | 940 | 1000 | 25 | 140 | −65 |
| Comparative Example 2 | 1150 | 1210 | 20 | 91 | −35 |
| Comparative Example 3 | 1100 | 1150 | 22 | 98 | −30 |

Figure 3:
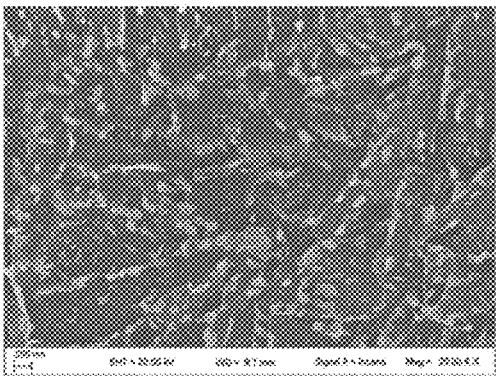
FIG. 3 shows the morphology of the precipitates in Comparative Example 2.
Figure 4:
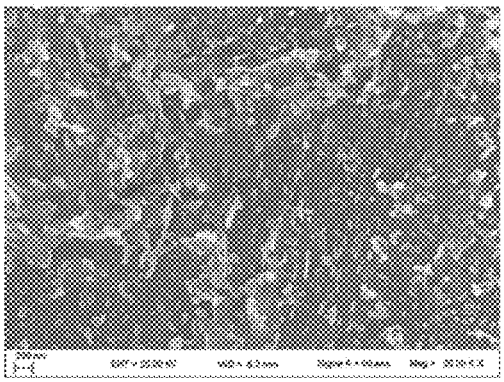
FIG. 4 shows the morphology of precipitats in Comparative Example 3.

It can be seen from Table 1, Table 2 and Table 3 that the composition of Comparative Example 1 does not satisfy the requirements of the present invention, wherein the C and V contents were low, so that the hardenability was low and the strength of the casing was not sufficient after the heat treatment. The higher C content in Comparative Example 2 results in the formation of a large amount of coarse precipitates (as shown in FIG. 3), resulting in a significant reduction in impact energy. The (V+Nb)/C ratio of Comparative Example 3 did not satisfy the requirements of the present invention, and a large amount of Cr and Mo precipitates were formed after the heat treatment (as shown in FIG. 4), so that the impact energy was also significantly reduced and the requirement of 10% yield strength value could not be satisfied.

In addition, it can also be seen from Table 1, Table 2 and Table 3 that the strength grade of the casing according to the present invention reached 155 ksi steel grade or more, the 0 degree transverse impact toughness exceeded 120 J, the elongation was ≥19%, the ductile-brittle transition temperature was ≤−55° C.

Figure 2:
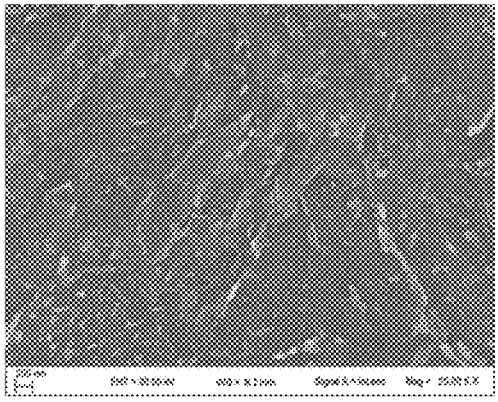
FIG. 2 shows the morphology of precipitates in Example 5 of the present invention.

As can be seen from FIG. 1, no banded structure due to component segregation was found on the metallographic structure of Example 5. The morphology of the precipitate of Example 5 observed by the high magnification scanning electron microscope is shown in FIG. 2, and as can be seen from FIG. 2, the precipitates were fine and uniformly distributed.

It must be noted that the above examples are merely specific embodiments of the present invention, and it is obvious that the present invention is not limited to the above embodiments, and many similar variations are accompanied thereby. All variations derived directly from or referred to by the person skilled in the art from the disclosure of the present invention shall fall into the protection scope of the present invention.

The invention claimed is:

1. A steel casing comprising a microstructure of tempered sorbite comprising a mass percent of chemical elements: C: 0.1-0.22%, Si: 0.1-0.4%, Mn: 0.5-1.5%, Cr: 1-1.5%, Mo: 1-1.5%, Nb: 0.01-0.04%, V: 0.2-0.3%, Al: 0.01-0.05%, Ca: 0.0005-0.005%, and the balance being Fe and unavoidable impurities, wherein the steel casing further satisfies a mass percent relation of $1 \leq (V+Nb)/C \leq 2.3$.

2. The steel casing according to claim 1, wherein precipitates on the tempered sorbite include at least one of a carbonitride of Nb and a carbonitride of V.

3. The steel casing according to claim 2, wherein the carbonitride of Nb has a size of 100 nm or less, and the carbonitride of V has a size of 100 nm or less.

4. The steel casing according to claim 1, wherein the casing steel further comprises Ti, and the content of Ti satisfies $0 < Ti \leq 0.04\%$.

5. The steel casing according to claim 4, wherein precipitates on the tempered sorbite comprise at least one of a carbonitride of Nb, a carbonitride of V and a carbonitride of Ti.

6. The steel casing according to claim 5, wherein the carbonitride of Nb has a size of 100 nm or less, the carbonitride of V has a size of 100 nm or less, and the carbonitride of Ti has a size of 100 nm or less.

7. The steel casing according to claim 1, wherein in the unavoidable impurities comprise $P \leq 0.015\%$, $S \leq 0.003\%$, and $N \leq 0.008\%$.

8. An oil casing, characterized in that the casing is obtained by using the steel casing according to claim 1.

9. The oil casing according to claim 8, wherein the casing is a 155 ksi grade casing with a yield strength of 1069-1276 MPa, a tensile strength of not less than 1138 MPa, an elongation of 20%-25%, a 0 degree transverse Charpy impact energy of not less than 130 J, and a ductile-brittle transition temperature of not lower than −60° C.

10. The oil casing according to claim 8, wherein the casing is a 170 ksi grade casing with a yield strength of 1172-1379 MPa, a tensile strength of not less than 1241 MPa, an elongation of 18%-25%, a 0 degree transverse Charpy impact energy of not less than 120 J, and a ductile-brittle transition temperature of not lower than −50° C.

11. A method of manufacturing the oil casing according to claim 8, comprising the steps of:

(1) smelting and casting the casing steel according to claim 1;

(2) piercing and rolling the casing steel in the step (1);

(3) and then heat-treating the casing steel in the step (2).

12. The method according to claim 11, wherein, in the step (3), the steel casing is austenitized at a temperature of 920-950° C., quenched after being kept at the same temperature for 30-60 minutes, and then tempered at 600-650° C., followed by being kept at the same temperature for 50-80 minutes, and then hot-straightening at 500-550° C.

13. The method according to claim 11, wherein, in the step (2), a continuous cast slab obtained through the step (1) is heated, and soaked at a temperature of 1200-1240° C., and then perforated at a temperature of 1180-1240° C., and finishing-rolled at a temperature of 900-950° C.

* * * * *